United States Patent [19]

Zocher

[11] 3,983,611

[45] Oct. 5, 1976

[54] KICK-UP BARB FOR FELTING NEEDLES

[75] Inventor: Josef Zocher, Aachen, Haaren, Germany

[73] Assignee: The Singer Company, New York, N.Y.

[22] Filed: Sept. 24, 1975

[21] Appl. No.: 616,350

[52] U.S. Cl. ..... 28/4 N
[51] Int. Cl.[2] ..... D04H 18/00
[58] Field of Search ..... 28/4, 4 N, 72.2 R

[56] References Cited

UNITED STATES PATENTS

| | | | |
|---|---|---|---|
| 3,641,636 | 2/1972 | Foster | 28/4 N |
| 3,815,186 | 6/1974 | Foster | 28/4 N |
| 3,913,189 | 10/1975 | Foster | 28/4 N |

*Primary Examiner*—Louis K. Rimrodt
*Attorney, Agent, or Firm*—Edward L. Bell; Robert E. Smith; A. Ruderman

[57] ABSTRACT

An improved felting needle barb having a kick-up of novel design such that the barb has greatly improved wear characteristics and more efficient transportation of fibers over an appreciable longer period of operation than existing felting needle barbs.

4 Claims, 4 Drawing Figures

KICK-UP BARB FOR FELTING NEEDLES

BACKGROUND OF THE INVENTION

The present invention relates to improvements in felting needles. U.S. Pat. No. 3,641,636 discloses a barb construction shaped to provide considerable strength and relatively smooth felting action upon the fibers. The present invention improves the barb construction of this patent by providing substantial mass at the tip of the barb extending from the front face of the tip rearwardly along a direction that is substantially parallel to the longitudinal axis of the needle blade. The trailing surface of the barb is preferably disposed at an angle such that during the retracting movement of the felting needle the trailing surface effects a reverse fiber transportation, the result of which is a concealment of the slightly visible needle holes on the needle entrance surface of the batt. This imparts to the material a better finish-appearing surface on the upperside thereof.

In addition, the barb adjacent its base is formed with fiber retention recesses extending along each side of the body of the barb, and these recesses function, during penetration of the fibers by the needle, the retain the picked up fibers close to the base of the barb. This minimizes the escape of the fibers off the exposed end of the barb.

SUMMARY OF THE INVENTION

It is the primary object of the present invention to provide a long-life barb having a kick-up disposed to extend beyond the edge of the needle blade and formed as the front face of a barb body that extends rearwardly and substantially parallel to the longitudinal axis of the felting needle.

It is a further object of the present invention to provide a long-life barb having fiber retention recesses formed adjacent the base of the barb and extending in a direction rearwardly of the face of the barb to reduce the sliding off of the fibers from the barb during the penetration stroke of the felting needle.

It is a still further object of the present invention to provide a felting needle barb having a cross-sectional configuration wherein the barb at the top of the kick-up has a width and the base of the barb also has a width which is only slightly larger than the width at the top of the barb.

DESCRIPTION OF THE PREFERRED EMBODIMENT

Figure 1:
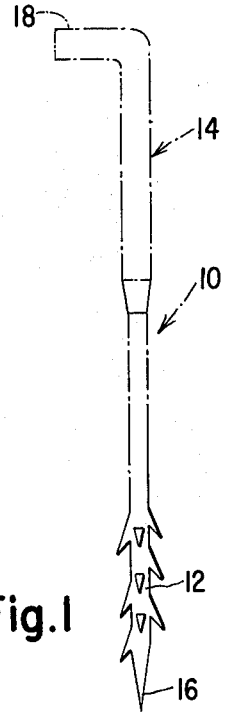
FIG. 1 is an elevational view of one form of felting needle of my present invention the barbs of which are fabricated as described herein below.

Referring now to FIG. 1 of the drawing, I have shown a felting needle 10 constructed in accordance with my invention which comprises a blade portion 12 and a shank portion 14. The lower end of the blade portion 12 is pointed as at 16 to facilitate penetration of fibrous material to be compacted in a known and conventional manner. The upper end portion of the needle may be bent substantially at right angles to the shank portion 14 to provide a securing element or ear 18 for clamping between a base member and a clamping member of a conventional needle plate (not shown). As is well known, such a needle plate is adapted to support a plurality of felting needles, such as shown in FIG. 1, which needles in the reciprocation of the plate in the felting machine effects the interlacing and compacting of loose fibrous materials.

Figure 2:
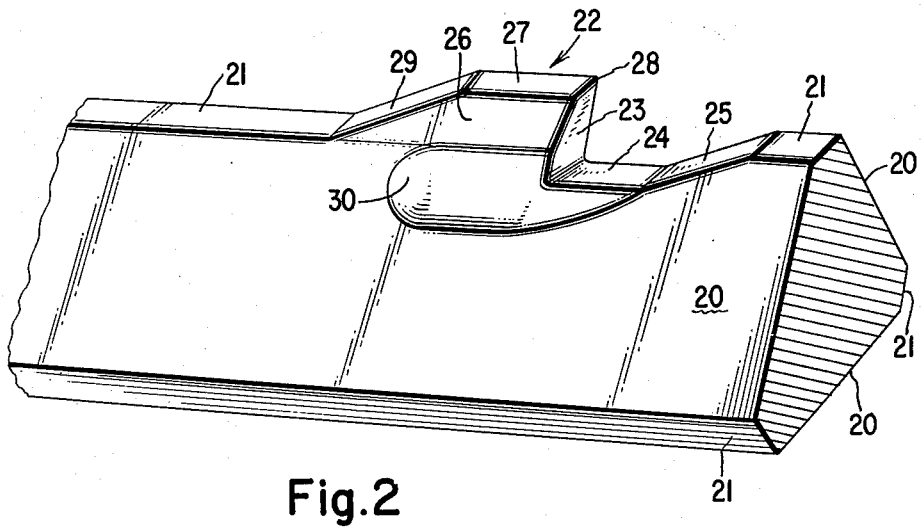
FIG. 2 is an enlarged perspective view of a portion of the body of the needle in FIG. 1 showing the improved barb construction of the present invention.

It is preferable in practicing my present invention to provide a felting needle having a salient angled blade portion, that is a blade portion having inclined side surfaces 20 merging into a flat edge surface such as shown at 21 in FIG. 2.

Through the use of die pressing operations, whereby material is caused to flow under pressure, barbs indicated as 22 in FIGS. 1 and 2 are produced. The felting needle blade portion which, in the present disclosure, is of triangular cross-section provides three edge surfaces at which barbs may be formed and in practicing my invention, a single barb may be formed in one or more of such three edge surfaces or a plurality of barbs may be provided in the three surfaces as desired.

Referring now to the important feature of my invention, the barb, of which the preferred form is illustrated in the accompanying drawing, is of the "kick-up" type. As shown best in FIGS. 2 and 3 the barb 22 of the present invention is formed with a front fiber engaging face 23 disposed in a plane arranged at an angle A to a plane perpendicular to the longitudinal axis of the felting needle. The face 23 is preferably flat and at its lower end merges into a bottom surface 24 that is preferably parallel to the longitudinal axis of the felting needle and is disposed at a level below the plane containing the edge surface 21. At its trailing or rearward end the bottom surface 24 blends into an upwardly inclined surface 25 arranged at an angle B with the bottom surface 24. Preferably, but not necessarily, angle B is approximately 20°.

Figure 3:
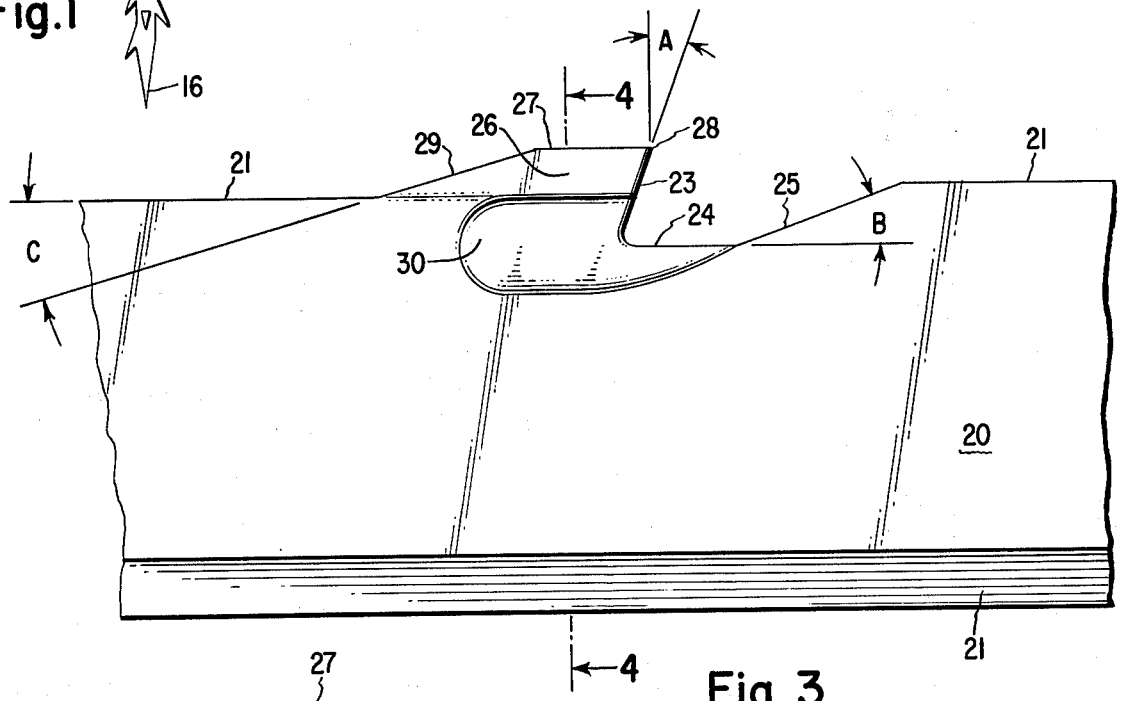
FIG. 3 is a side elevational view of the same portion of the needle body shown in FIG. 2.

As shown in FIGS. 2 and 3 the kick-up barb is formed with a body portion 26 which extends in a direction parallel to the longitudinal axis of the felting needle, and it preferably has a length that is equal to or greater than the depth of the barb. The body portion 26 is formed with a flat top surface 27 merging at its front end into the front face 23 to provide a fiber engaging edge 28. At its rear the body portion 26 is inclined downwardly to blend into the edge surface 21 and provide a fiber engaging surface 29 which is effective during the retracting stroke of the needle to effect reverse transportation of the fibers. The angle of inclination of surface 29 is indicated as C and it has been determined that an angle of approximately 15° results in very satisfactory reverse transportation of the fibers. It will be noted that as a result of the reverse transportation of fibers the slightly visible needle punctures, which are present on the needle penetration side of the fibrous material if no reverse fiber transportation is effected, are eliminated by the protruding fibers that cover the needle punctures. The long-standing requirement by the trade of a felting needle capable of producing two direction transportation of the fibers is satisfied by the novel barb construction constituting the present invention.

Figure 4:
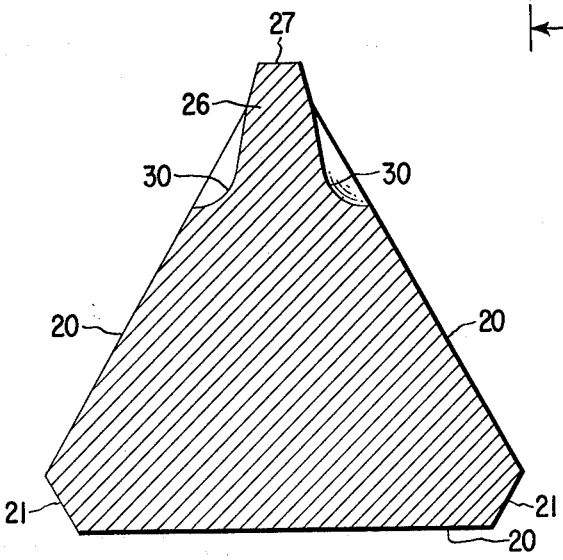
FIG. 4 is a cross-sectional view taken along the line 4—4 of FIG. 3.

Another important feature of my novel kick-up barb is the provision of fiber retention recesses, indicated as 30, that are provided at the base of the barb, one on each side thereof. It will be understood that the recesses 30 function to retain the picked-up fibers that are being transported in such a manner as to retard the fibers on the front face of the barb as illustrated in FIG. 4 the recesses 30 are substantially concave in cross section from premature escape off the exposed top edge of the barb. In order to minimize the breaking of the fibers during there transportation all the corners on the barb are rounded off as is clearly shown in FIG. 2.

From the above description it will be appreciated that a novel kick-up barb has been provided in which the barb has a substantial body portion having a uniform height and extending in a direction parallel to the longitudinal axis of the needle, whereby wear on the front of the barb simply reduces the length of the body portion thereof without reducing the height of the barb and thus its fiber transporting efficiency. The ultimate result is a long-life barb capable of functioning at maximum efficicency throughout its life. Contributing to the long-life of the barb is its dimensions in cross-section as illustrated in FIG. 4. It is to be noted that the flat top surface 27 of the barb is of a width slightly less than that of the base, resulting in a barb having a reasonable mass. In prior art barbs of the kick-up type the cross-section configuration is triangular with the top of the barb formed as a point and without any body portion in back of the point to accommodate any wear of the barb. Thus, after use of the triangular shaped barb wear reduces its height and thus its ability to transport the fibers uniformily over its comparative life.

Numerous alterations of the structure herein disclosed will suggest themselves to those skilled in the art. However, it is to be understood that the present disclosure relates to a preferred embodiment of my invention which is for purposes of illustration only and not to be construed as a limitation of the invention. All such modifications which do not depart from the spirit of the invention are intended to be included within the scope of the appended claims.

Having thus set forth the nature of this invention, what is claimed is:

1. A felting needle comprising a blade portion having at least two inclined side surfaces merging into a flat edge surface, a fiber transporting kick-up barb provided on said flat edge surface having a body portion extending in a direction parallel to the longitudinal axis of said needle blade portion and defined by a substantially flat top surface located above the level of said flat edge surface of said needle blade, said body portion of said barb formed with a fiber engaging front face extending inwardly from the top of said body portion toward the center of said needle blade portion to a point below the level of said flat edge surface of said needle blade portion, and a bottom surface provided on said needle blade portion merging at its front edge into the bottom of said fiber engaging front face of said barb and at its rear end merging into an upwardly inclined surface that terminates in said flat edge surface of said needle blade portion, the flat top surface of said barb having a length at least as long as the distance from the top flat edge surface of said barb to said bottom surface of said needle blade portion.

2. A felting needle as defined in claim 1, wherein the rear end of the body portion of said barb is inclined and merges into the top flat edge surface of said needle blade portion.

3. A felting needle as defined in claim 2, wherein the angle of inclination of the rear of the body portion is at least 15°.

4. A felting needle as defined in claim 1, wherein each side of the barb body portion is formed with a fiber retaining recess disposed parallel to the longitudinal axis of said needle blade portion, each recess being of a substantially concave configuration in a plane normal to the longitudinal axis and having its front end opening into the fiber engaging face of said barb.

* * * * *

UNITED STATES PATENT OFFICE
CERTIFICATE OF CORRECTION

PATENT NO. : 3,983,611
DATED : October 5, 1976
INVENTOR(S) : Josef Zocher

It is certified that error appears in the above-identified patent and that said Letters Patent are hereby corrected as shown below:

Column 3, line 4 after "barb" delete -- as illustrated in FIG.

Column 3, line 5 delete -- 4 the recesses 30 are substantially concave in cross --

Column 3, line 6 delete -- section --

Column 3, line 7 after"barb." insert -- As illustrated in FIG. 4 the recesses 30 are substantially concave in cross section. --

Signed and Sealed this

Twenty-second Day of February 1977

[SEAL]

*Attest:*

RUTH C. MASON
*Attesting Officer*

C. MARSHALL DANN
*Commissioner of Patents and Trademarks*